US006090018A

United States Patent [19]

Laudenslager et al.

[11] Patent Number: 6,090,018

[45] Date of Patent: Jul. 18, 2000

[54] MOUNT FOR A PUNCHING BAG

[75] Inventors: Andrew R. Laudenslager; Peter B. Pecsvaradi, both of Allentown, Pa.

[73] Assignee: Balazs Inc., Allentown, Pa.

[21] Appl. No.: 09/197,633

[22] Filed: Nov. 23, 1998

[51] Int. Cl.[7] ..... A63B 7/02

[52] U.S. Cl. ..... 482/87; 482/83; 482/90

[58] Field of Search ..... 248/339; 267/177, 267/175; 473/441–445; 482/83–90

[56] References Cited

U.S. PATENT DOCUMENTS

| | | | |
|---|---|---|---|
| D. 335,513 | 5/1993 | Gaetano . | |
| 965,838 | 7/1910 | Sanborn, Jr. | 267/177 |
| 1,733,508 | 10/1929 | Minor | 248/339 |
| 3,281,148 | 10/1966 | Cummins | 482/87 |
| 3,995,822 | 12/1976 | Einhorn et al. | 248/339 |
| 4,216,957 | 8/1980 | Curatola . | |
| 4,345,755 | 8/1982 | Eidson | 482/87 |
| 4,660,827 | 4/1987 | Servadio . | |
| 4,721,302 | 1/1988 | Murphy . | |
| 4,738,444 | 4/1988 | Linden | 482/24 |
| 4,911,428 | 3/1990 | Wiece . | |
| 5,048,822 | 9/1991 | Murphy . | |
| 5,330,398 | 7/1994 | Barbafieri | 482/24 |
| 5,460,343 | 10/1995 | Hestilow . | |
| 5,476,433 | 12/1995 | Bruner . | |
| 5,725,458 | 3/1998 | Newman et al. . | |
| 5,863,278 | 1/1999 | Chen | 482/83 |

*Primary Examiner*—Jerome Donnelly
*Attorney, Agent, or Firm*—Richard P. Gilly

[57] ABSTRACT

A mount for securing a punching bag or other exercise equipment to a support structure has a helical spring nested around a rotatable, slidable rod. The resulting structure relieves torsional stresses and absorbs longitudinal forces experienced by the punching bag or other exercise equipment during its use, thus prolonging the life of such bag or equipment. The nested or non-serial connection of elements in the mount shortens the operative length of the mount, which is advantageous when the vertical mounting location for the bag or equipment is limited, such as by the presence of a standard ceiling.

25 Claims, 5 Drawing Sheets

MOUNT FOR A PUNCHING BAG

FIELD OF THE INVENTION

This invention relates to exercise equipment and, more particularly, to mounts for securing exercise equipment, such as punching bags, to a support structure.

BACKGROUND OF THE INVENTION

Punching bags for training in boxing, martial arts, or other physical fitness activities are subjected to a great variety and number of forces, generally of great magnitude, during the use of such bags. These forces include torsional forces caused by blows to the bag which would otherwise cause the bag to rotate. The bag also experiences vertical forces caused by either vibration of the bag itself, or by vertical components of the blows exerted on the bag.

The above-described forces tend to concentrate at locations from which the punching bag is suspended, such as the tabs or other attachment mechanisms on the upper end of a suspended punching bag. As such, the torsional and vertical forces applied to the bag during its use may cause the bag to fatigue or wear prematurely, especially at the attachment points where stresses are concentrated. The deleterious effect of these forces is all the more severe when the bag is being freely suspended, as is normally the case, and when the bag is one of the so-called "heavy" bags, generally filled with sand or water and weighing up to 150 lbs.

It is therefore desirable to reduce or eliminate unnecessary forces which would otherwise arise during use of the punching bag. One approach to relieving stresses caused by rotation of the bag is to mount the bag with a swivel or similar connection which pivots or rotates in a substantially horizontal plane. While this approach may assist in relieving torsional stresses, it does little or nothing to address the vertical forces, vibrations, and other non-rotational forces experienced by the bag during its use.

Another mounting technique, such as shown in U.S. Pat. No. 5,725,458 makes use of a helical spring connected in series between the I-bolt of the mount and the top of the punching bag to be suspended. While this attempted solution may reduce some of the vibrational forces experienced by the punching bag so suspended, it has various drawbacks and other disadvantages. For example, in order to maintain a robust mounting connection to the structure supporting the punching bag, the helical spring is simply connected in series to an I-bolt of the supporting structure.

As a result, the helical spring extends downwardly from the vertical location where the punching bag would otherwise be suspended. The weight of the punching bag also extends the length of the spring by a predetermined amount. The serial attachment of the spring, and the fact that the spring is in tension when the punching bag is suspended thereon, both lower the actual height at which the punching bag is suspended. By lowering the height of the mounting location of the punching bag, the height of the punching bag itself is lowered by an amount at least equal to the length of the helical spring and the amount of its extension under tension. The mounting location height is lowered still further if a swivel connection is added above or below the helical spring, as is sometimes done currently.

The lowering of the punching bag is particularly significant when a bag is suspended from an indoor mounting structure or from a standard ceiling with a height of only about 8 feet. In such situations, the bag may be undesirably low for users beyond a certain height. In addition, if the bag is used by such users, the forces normally exerted on the bag are exerted even closer to the top of the bag, compounding the already extreme stress concentrations occurring at the attachment points at the top of the bag.

The extended length of the helical spring configuration described in U.S. Pat. No. 5,725,458 also increases the likelihood that the heavy bag will swing undesirably during its use. More particularly, increasing the distance between the mounting location of the bag and the top of the bag increases the moment arm of the forces acting on the punching bag as a result of blows received thereon. As a result, forces on the bag can more readily displace it, thus starting it to swing. Such swinging often interferes with the "rhythm" or effectiveness of the workout for which the bag is being used. Furthermore, the increased moment arm further concentrates stress on the aforesaid mounting locations, leading again to premature wear or fatigue.

The costs and inconvenience of replacing or repairing exercise equipment make it all the more imperative to avoid premature fatigue or degradation of such exercise equipment.

There is thus a need for a mount for exercise equipment which relieves not only torsional stresses, but also absorbs and thereby reduces longitudinal forces and vibrations, all without unnecessarily lowering the height at which the bag is suspended.

There is a further need for a mount to be versatile and useful in connection with a variety of support structures for exercise equipment.

There is yet a further need for such a mounting structure to be robust enough to operate as intended in the sometimes harsh conditions of supporting a heavy punching bag subjected to repeated blows or pummelings, often of great magnitude.

SUMMARY

In accordance with the present invention, a mount is provided for securing a punching bag to a support structure. The mount includes a first component which receives the punching bag thereon, a second component which rotates in response to rotation or torsional forces exerted on the punching bag, and a third component which absorbs longitudinal forces exerted on the mount. One important aspect of the invention is for the rotating component and the component which absorbs the longitudinal forces to be connected to each other non-serially. In this way, the mount of the present invention has a predetermined, overall length which does not exceed the longer dimension of either the rotating component or the absorbing component.

In accordance with another aspect of the present invention, the rotating component comprises a rod which is rotatably received through an aperture defined in the mount. The rod has an end which is connected to a clip on which the punching bag is mounted. The mount has a passage into which the rod extends. The rod can slide relative to the passage because the passage has an inner diameter larger than the diameter of the rod. A helical spring is coaxially received around the rod. One end of the spring is biased relative to the support structure, and the other end of the spring is biased relative to the rod. In this way, forces which slide the rod relative to the support structure during use of the bag are absorbed by the spring acting on the rod relative to the support structure. Furthermore, because the helical spring is mounted in compression, it has a length less than or equal to the rod and does not increase the overall length of the mount. In this way, the height at which the heavy bag is suspended is not unnecessarily lowered, and the tendency of the bag to swing is likewise not increased.

The invention may also take the form of a stand for holding exercise equipment, such exercise equipment including but not limited to punching bags. The stand includes a base, an arm, and structures for securing the arm at a predetermined height above the base. A mount is secured to the arm, the mount including structures arranged non-serially not only for rotating a bag mounted thereto, but also for absorbing longitudinal forces, including vibrations, experienced by the bag during its use.

Any of a variety of support structures for holding exercise equipment can be equipped with the mount in accordance with the present invention. In one version, the support structure has members which allow it to be secured either to a ceiling or to a wall.

In the drawings, which are discussed below, one or more preferred embodiments are illustrated, with the same reference numerals referring to the same features of the invention throughout the drawings. It is understood that the invention is not limited to the preferred embodiments depicted in the drawings herein, but rather is as defined by the claims appended hereto and equivalent structures.

DETAILED DESCRIPTION

While the specification concludes with claims particularly pointing out and distinctly claiming the subject matter which is regarded as the invention, the invention will now be further described by reference to the following detailed description of preferred embodiments taken in conjunction with the above-described accompanying drawings.

Figure 1:
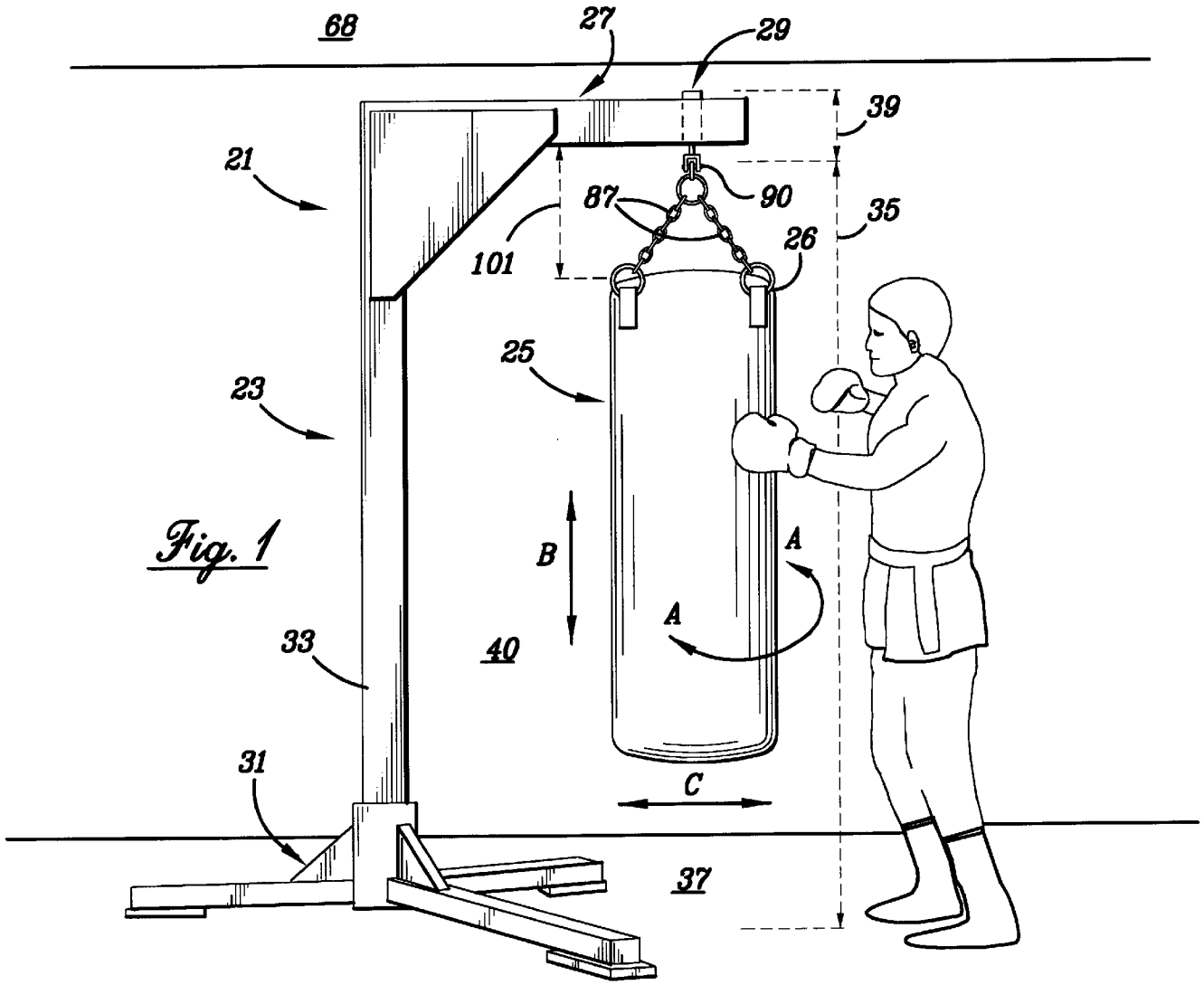
FIG. 1 is a perspective view of a single-station exercise stand incorporating the principles of the present invention.

Referring now to the drawings, and in particular to FIG. 1, a support structure 21, preferably in the form of a stand 23 for holding exercise equipment, is shown incorporating the principles of the present invention. A punching bag 25 is attached to support structure 21 and suspended from arm 27 by means of mount 29. Stand 23 includes means, here shown as base 31 and vertically extending elongated member 33, for securing mount 29 at a pre-determined height 35 above substantially horizontal surface 37 on which base 31 rests.

The punches, blows, jabs, pummelings, and the like experienced by bag 25 during use translate into a variety of forces. These forces include: torsional or rotational forces indicated by arrows A; longitudinal forces, including vibrations, indicated by the arrows B; and forces causing swinging of the bag, indicated by arrows C. Mount 29 according to the present invention includes structures which absorb longitudinal forces, including vibrations of bag 25, and structures which relieve torsional forces by allowing rotation of bag 25. The foregoing structures are connected non-serially to each other and hence minimize the overall length 39 of mount 29. By minimizing the overall length of mount 29, punching bag 25 can be suspended at a higher vertical location. Thus, mount 29 accomplishes its shock-absorbing functions in a relatively compact configuration which maximizes the value of predetermined height 35 at which bag 25 is suspended, and which also minimizes the undesirable tendency of punching bag 25 to swing in the directions indicated by arrows C.

Figure 2:
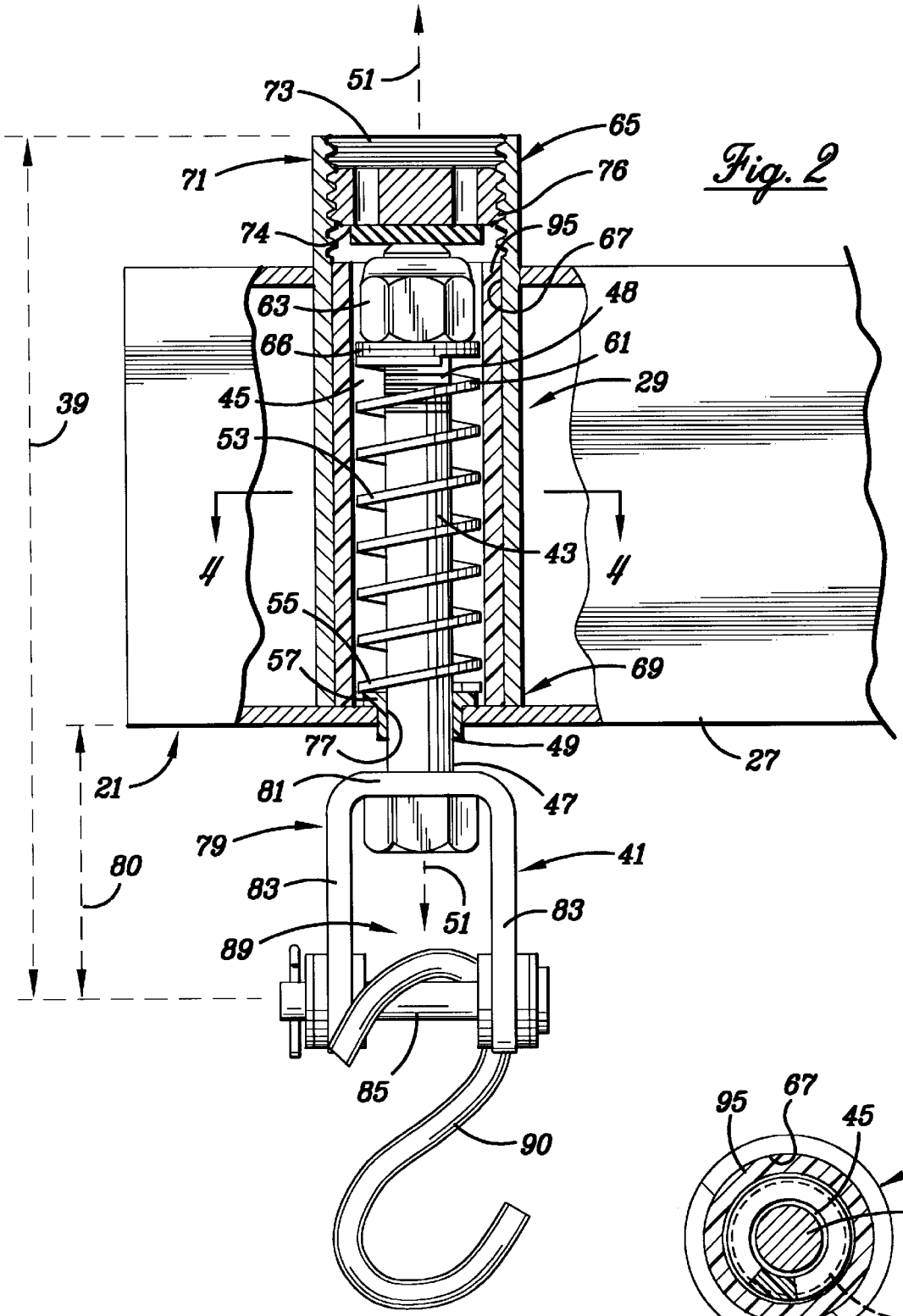
FIG. 2 is an enlarged, side-elevational view of the arm of the stand, showing the mount partly cut-away.
Figure 4:
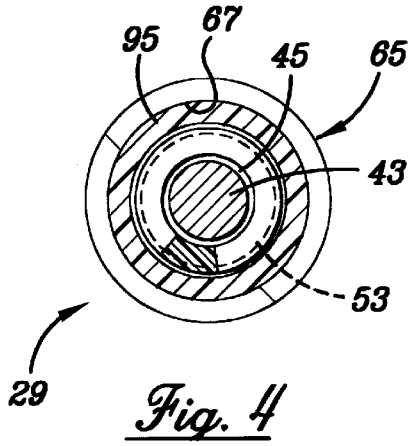
FIG. 4 is a cross-sectional view of the mount of FIG. 3 taken along line 4—4.
Figure 3:
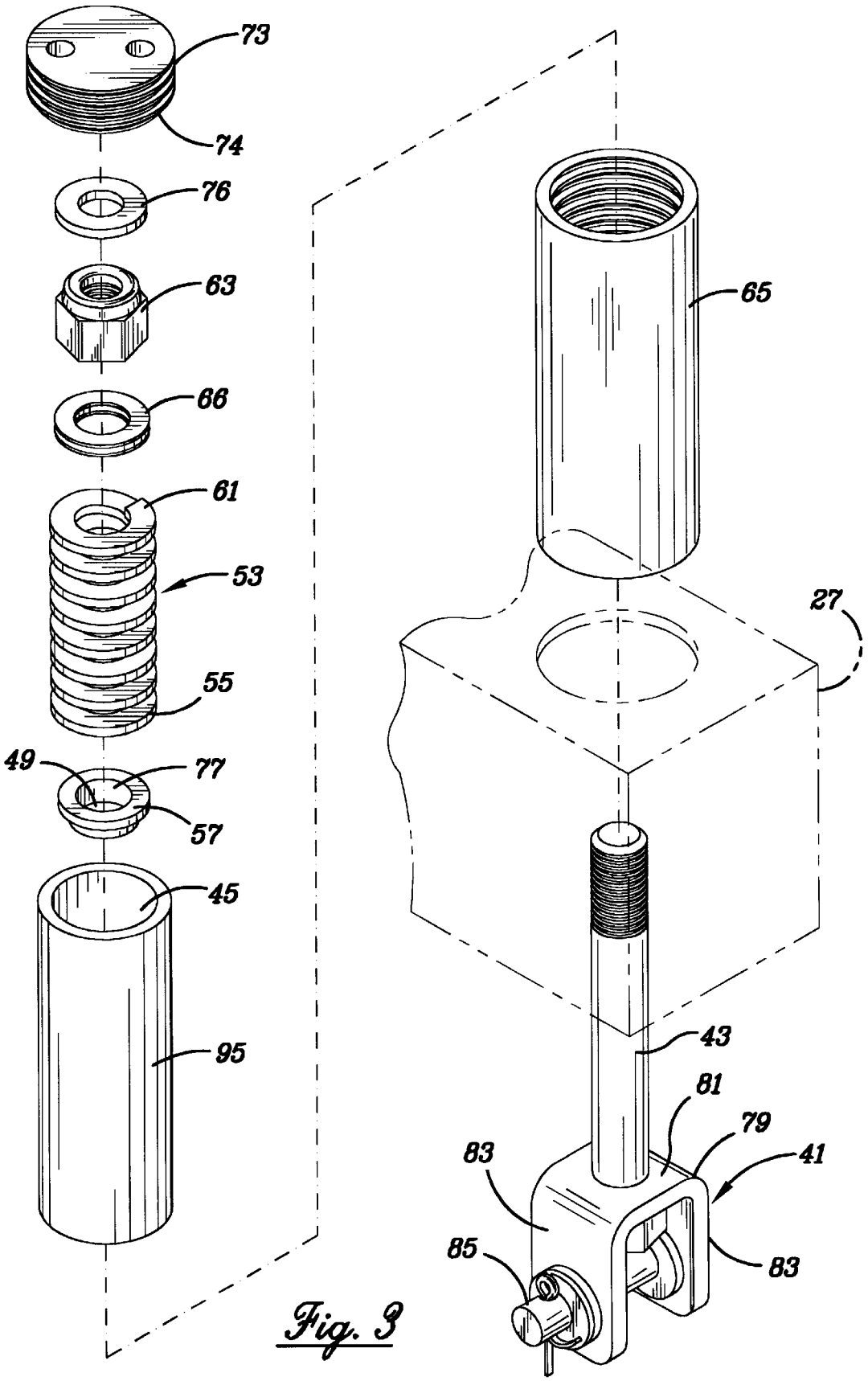
FIG. 3 is an exploded, perspective view of the mount of FIG. 2.

Referring now to FIGS. 2–4, mount 29 is shown formed and located within the larger support structure 21. Mount 29 includes a clip 41 to which punching bag 25 is attached, in this case being suspended therefrom. A rod 43 is rotatably and slidably received in a passage 45 defined in mount 29. End 47 of rod 43 protrudes from opening 49 and is connected by any suitable means to clip 41. Because the outer diameter of rod 43 is smaller than the inner diameter of opening 49 and passage 45, rod 43 and clip 41 attached thereto swivel or pivot about longitudinal axis 51 of rod 43 in response to rotational forces exerted on bag 25, such as those shown by arrows A (FIG. 1.)

Spring means, preferably in the form of helical spring 53, include a longitudinal spring axis which coincides with longitudinal axis 51 of rod 43. In this way, helical spring 53 is coaxially received around rod 43. Spring 53 has one spring end 55 biased relative to support structure 21 and mount 29. That is, spring end 55 is biased against a mounting bushing 57 which is secured relative to support structure 21. (Suitable washers or spacers (not shown) may be interposed between spring end 55 and bushing 57 to assist in seating of spring end 55 thereon.)

The other spring end 61 is biased relative to rod 43. Specifically, spring end 61 is biased and abuts a nut 63 threadably secured to rod 43. Helical spring 53 and rod 43 are preferably selected so that helical spring 53 is in a compressed state. Such arrangement not only eliminates undesirable play at all times, but also maintains spring 53 in a nested, non-serial relationship with rod 43, with the resulting advantage that the overall length 39 of mount 29 is reduced.

In this embodiment, a needle bearing 66 is interposed between spring end 61 and the base of nut 63. Additional washers or flanges (not shown) may also be interposed to assist in seating spring end 61 and facilitating rotation of nut 63 to adjust spring tension of spring 53 as discussed below. By biasing spring ends 55, 61 in this manner, the forces associated with longitudinal, sliding motion of rod 43 are absorbed by helical spring 53.

Nut 63 is threadably received at the biased end of rod 43. Spring end 61 is in operative contact with nut 63. This means that, by advancing or retracting nut 63, needle bearing 66 is likewise advanced or retracted, and the effective length of spring 53 is adjusted, which, in turn, adjusts the tension in spring 53. Such tension adjustment, in turn, adjusts the suspension and absorbing characteristics of mount 29 when a bag 25 is received thereon. For example, increased spring tension suspends the bag slightly higher and absorbs vibrations less readily, and the converse occurs when spring tension is lessened by backing off the nut 63. Needle bearing 66 facilitates adjustment of nut 63 without undesirable rotation of spring 53.

Since spring 53 remains compressed under normal load conditions, spring 53 has an operational length which is less than or equal to the length of rod 43. As discussed previously, by maintaining such operational length less than the length of rod 43, spring 53 does not increase the overall length of mount 29.

Referring again to FIG. 1, it will be appreciated that the resulting non-serial connection of rod 43 and spring 53 increases the maximum value of the height 35 at which bag 25 can be suspended from mount 29. This increase in height is especially significant when ceiling 68 is of standard height. Ceiling 68 inherently limits the height of the support structure 21, the height of suspension arm 27 extending therefrom, and the height of mount 29 affixed to suspension arm 27 in this embodiment. Thus, since mount 29 cannot be vertically raised to increase the height 35 at which bag 25 is suspended, the length of mount 29 becomes a critical factor in making a maximum amount of height available for suspending the bag 25.

Tests have shown that the present invention allows the maximum height for suspending bag 25 to be increased by greater than 14½ inches. Such increase is especially significant for taller users of bag 25, who would otherwise be striking bag 25 at an undesirably high location nearer to the top 26 of the bag 25. By increasing the maximum available suspension height, mount 29 reduces the likelihood of excessively high blows to bag 25. Such excessively high blows would otherwise subject bag 25 to increased stresses, would cause bag 25 to respond to blows atypically, and thus would potentially diminish the effectiveness of a user's workout.

A sleeve 65 is defined either in mount 29 or support structure 21, depending on how support structure 21 and mount 29 are constructed and affixed relative to each other. In the illustrated embodiment, sleeve 65 is welded to arm 27 and secured in a suitably formed cavity. Sleeve 65 and arm 27 may alternately be formed of one piece. As a further alternative, sleeve may be integrated into other parts of the support structure 21, or sleeve may be a separate component bolted to or otherwise releasably secured to a suitable location on the support structure 21. Sleeve 65 is substantially cylindrical and has a circumferential inner wall 67. Inner wall 67 extends between opposite ends 69, 71 of sleeve 65, and defines the passage 45 into which rod 43 extends longitudinally as discussed previously.

A cap 73 is secured to end 71 of sleeve 65 and is threadably received therein. Cap 73 keeps foreign matter from entering passage 45 and compromising the sliding motion of rod 43 and the other functions of mount 29. In addition, cap 73 serves as an upper limit to the longitudinal movement of rod 43. Specifically, inner surface 74 of cap 73 has a rubber washer 76 or equivalent member thereon. Such washer 76 is struck by the corresponding end of rod 43 whenever suitable longitudinal force is experienced by rod 43. Cap 73 is located within sleeve 65 so that the above-described upper limit is reached before clip 41 contacts support structure 21, thus avoiding damage to clip 41 or to other operative parts of mount 29.

Mounting bushing 57 has end 47 of rod 43 protruding therethrough. In particular, an inner bushing wall 77 (FIG. 3) defines opening 49 in mounting bushing 57. Inner bushing wall 77 extends a predetermined longitudinal distance, preferably about ¾ of an inch, opposite and in close proximity to rod 43 extending therethrough. The longitudinal distance through which bushing wall 77 extends, and its proximity to rod 43, are selected so as to minimize the amount which longitudinal axis 51 of rod 43 may tilt relative to the corresponding longitudinal axis of sleeve 65. In this way, forces normal to longitudinal axis 51, such as those caused by swinging motions of the bag, do not induce corresponding motions in rod 43. Thus, means have been provided to inhibit tilting of rod 43 relative to such longitudinal axis 51. Conversely, by preventing rod 43 from tilting in this manner, undesirable swinging of punching bag 25, such as in the directions shown by arrows C (FIG. 1), is likewise inhibited. As a result, the punching bag 25 remains more optimally positioned and stable during its use.

Clip 41 is one preferred means for attaching, receiving, or suspending punching bag 25 from mount 29. Clip 41 comprises a U-shaped yoke 79 having a base 81. A pair of substantially parallel clip arms 83 extend outwardly from base 81, and a removable pin 85 extends transversely between clip arms 83. Clip 41 is operatively connected to rod 43, meaning that either directly or indirectly, base 81 is secured to rod end 47. Preferably, clip 41 is secured to rod 42 so that movement of clip 41 causes movement of rod 42, although other attachment arrangements may be interposed between clip 41 and rod 43. For example, clip 41 may be rotatably connected to rod 43, so that clip 43 swivels to relieve torsional forces in the direction of arrows A (FIG. 1.).

Punching bag 25 or other exercise equipment is attached to pin 85 generally by a plurality of chains 87 (FIG. 1) extending upwardly from the top 26 of punching bag 25 and converging in a ring and S-shaped hook 90. The S-shaped hook 90 has its upper arm received through space 89 defined between yoke 79 and pin 85 (FIG. 2).

Helical spring 53 has a spring constant selected to perform a number of functions. First, spring 53 is selected to maintain rod 43 substantially within sleeve 65 not only during normal load conditions, but also during absorption of vertical forces caused by movement of rod 43 relative to spring 53. Second, spring 53 is also selected to exert sufficient force to absorb those forces likely to be encountered during use of bag 25. Thus, end 47 of rod 43, which is connected to clip 41, preferably protrudes a suitable, but minimal, distance from sleeve 65. And when mount 29 is oriented with clip 41 protruding downwardly from sleeve 65, the bag 25 which is attached to clip 41 is suspended at a vertical location adjacent to lower end 69 of sleeve 65. By keeping clip 41 substantially adjacent to lower end 69 of sleeve 65, vertical distance 101 (FIG. 1) between top 26 of bag 25 and support arm 27 is substantially minimized, again with the advantage of positioning bag 25 higher relative to ceiling 68.

The use and operation of the present invention is readily apparent from the foregoing description. In general terms, mount 29 holds punching bag 25 in a suspended position from its clip 41. The punching bag 25 can then be subjected to any of the variety of punches, blows, or similar forces from any of a variety of exercise routines. During such use, torsional (rotational) forces are relieved by virtue of the ability of mount 29 to pivot or swivel about its longitudinal axis. Similarly, helical spring 53 acts against sliding motion of rod 43. The corresponding longitudinal forces experienced by punching bag 25 shown by arrows B, including vibration, are absorbed by spring 53. The mount 29 is structured to increase the available height at which bag 25 is suspended. The mount 29 also alleviates undesirable swinging of the bag 25.

Sleeve 65 has a length of about 4.0 inches, an inner diameter of about 1 inch, and an outer diameter of about 1¼ inches. Rod 43 has a diameter of about ½ inch, and friction reducing bushing 95 has an outer diameter of about 1¼ inch and an inner diameter of about 1 inch, with an overall length of about 3½ inches. Helical spring 53 is preferably a chrome-vanadium die spring with a free length of about 2½ inches to about 3 inches. It has an outer diameter of about 1 inch and an inner diameter of about ½ inch. At one-half of its deflection, the spring supplies a force of about 250 lbs., thus giving it a spring constant K of about 200 lbs. per inch. Although the above spring characteristics have been found suitable for heavy bags, other variations are likewise acceptable, and may even be preferred for suspending or otherwise holding different exercise apparatus.

Figure 5:
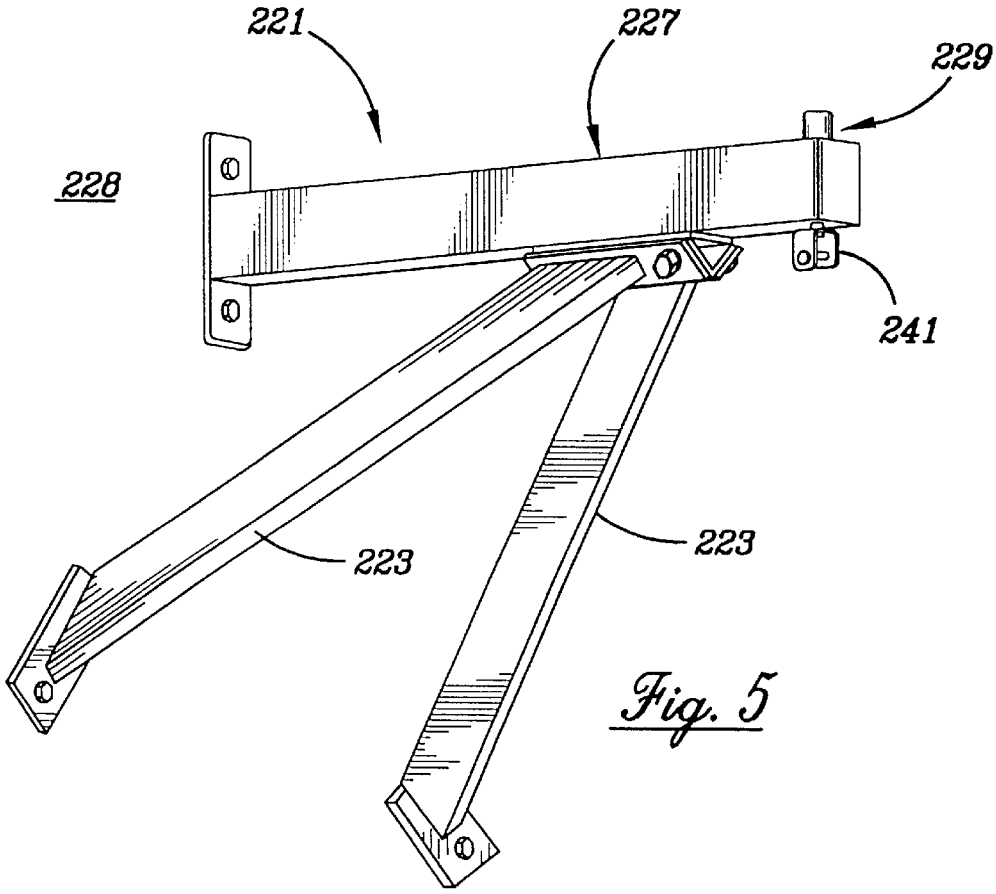
FIG. 5 is a support structure and mount according to the present invention for securing to a wall or other substantially vertical structure.

Although mount 29 shown in FIGS. 1–4, is part of a support structure 21 in the form of a stand 23, alternative configurations to support structure 21 may also be constructed in accordance with the present invention. For example, FIG. 5 shows a first alternative support structure 221. The interconnected, elongated members of support structure 221 are positioned relative to each other so that support structure 221 may be attached to a vertical surface, such as wall 228. Arm 227 is attached at one end to wall 228 and extends outwardly to terminate at an opposite end where mount 229 is secured. A pair of braces 223 is secured to the outwardly extended end of arm 227 at one end, and to wall 228 at the other end. Mount 229 is oriented so that clip 241 protrudes downwardly as in the previous embodiment, and the remaining structural features of mount 229 are as previously discussed with reference to the previous embodiment.

Figure 6:
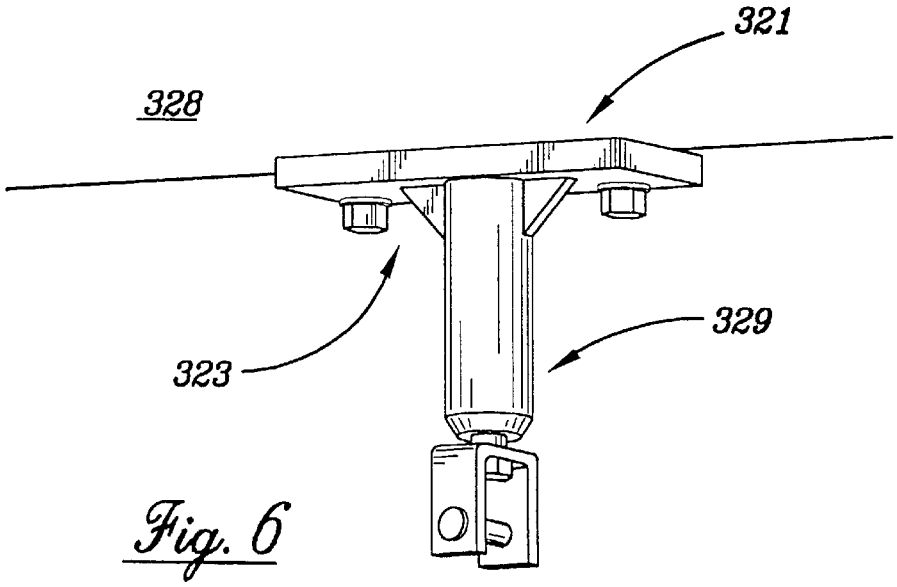
FIG. 6 is a support structure and mount according to the present invention for securing to a ceiling or other horizontally oriented, suspension surface.

A second alternative support structure is shown in FIG. 6. Support structure 321 provides for securing mount 329 relative to a ceiling 328. In this embodiment, mount 329 is in the form of a central, cylindrical housing, and a cross beam 323 connected to the upper end of the housing. Cross beam 323 extends outwardly from the housing of mount 329 and terminates in opposite ends. The ends, in turn, are provided with suitable means for attaching cross beam 323 to ceiling 328 or another substantially horizontal surface. In a further variation (not shown), cross beam 328 is located at the lower end of mount 329, so that support structure 321 can be secured to a pair of joists in a recessed ceiling.

Each of the support structures 21, 221, 321 defines an exercise "station" at which the punching bag or other exercise equipment is used. One such station 40 is shown in FIG. 1, occupied by a single boxer. The respective mounts 29, 229, 329 would be positioned in operative proximity to the stations defined by the corresponding support structures 21, 221, 321. As a further alternative, the support structures can be configured to define multiple exercise stations, each having a punching bag or other exercise device located therein. One or more of the stations can include the appropriate mount 29, 229 or 329 for holding the exercise equipment.

It should also be noted that although the present invention has been illustrated in association with heavy punching bags, the mount and associated support structure is equally useful in holding any sort of stationary exercise equipment subjected to forces during its use. Such equipment includes martial arts equipment, weights, aerobic equipment, football training apparatus, and other sports equipment where it is desired to hold a work piece in a relatively fixed position during a workout.

The mount according to the present invention, and its associated support structure, may assume still other alternative configurations, depending on the intended application. For example, instead of using a helical spring 53, mount 29 can use spring means in the form of a gas cylinder or so-called "gas spring" with yoke 79 rotatably mounted thereto. As typical in such gas springs, movement of the rod 43 would alternately pressurize or depressurize gas residing in a relatively air-tight chamber into which rod 43 extends. Such pressure changes, in turn, would absorb the forces associated with motion of rod 43.

In another alternative, spring means comprises a resiliently compressible elastomer, rather than the helical spring 53. The elastomer is introduced within the chamber defined by sleeve 65, and is compressed by motion of rod 43 relative thereto, with the result that associated longitudinal forces are absorbed.

In yet another alternative, clip 41 may be pivotally mounted about rod 43. In particular, base 81 of yoke 79 is provided with an aperture, with protruding end 47 of rod 43 received therethrough. The head of protruding end 47 extends radially outwardly a sufficient distance to provide a seat for base 81, and yoke 79 thus rotates relative to such seat.

Figure 7:
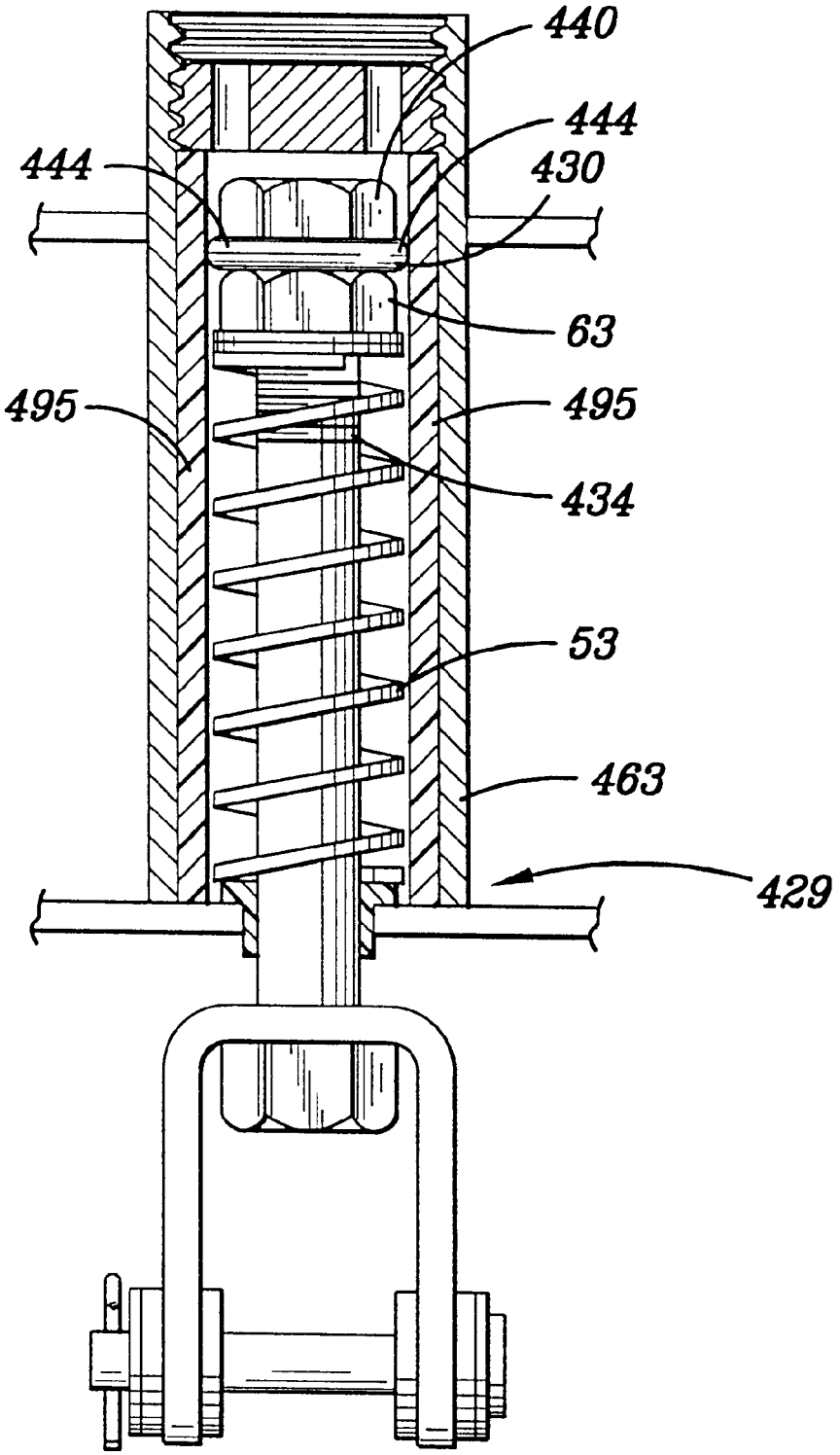
FIG. 7 is a an enlarged, partly cut away, side elevational view of an alternative embodiment of the present invention.

As still another alternative, mount 29 can optionally be equipped with means or dampening movements of rod 43. One such dampening means, shown in FIG. 7, is rubber, polymeric or elastomeric component 430 axially mounted on rod 434 of mount 429. Mount 429 is generally similar to mounts 29, 229, 329, except rod 434 is structured so as to receive a second nut 440 thereon. The elastomeric component 430 is preferably in the form of a ring or washer, and is interposed between adjustment nut 63 and nut 440. Rotation of nuts 63, 440 toward each other compresses elastomeric component 430 and, if sufficiently compressed, urges side portions 444 of component 430 against inner wall of bushing 495. Contact between portions 444 and bushing 495, in turn, dampens motion of rod 434 relative to sleeve 463. Alternative dampening means in the form of incompressible fluids may also be used within the mount 29. Such hydraulic systems would add dampening to the absorption functions otherwise accomplished by spring 53 alone.

In addition to the advantages apparent from the foregoing description, the mount according to the present invention accomplishes its functions in a more compact, shorter-length structure than currently available. By connecting a slidable and rotatable rod and a helical spring in a nested or non-serial arrangement, the inventive structure gives the advantages of force absorption and relief of torsional stresses without unduly increasing the overall length of the mount. The ability to absorb forces and relieve torsional stresses, in turn, prolongs the life of the punching bag or other exercise equipment suspended by the mount.

The ability to provide both force absorption and relief of torsional stresses in a more compact structure has the further advantage of increasing the maximum height at which a punching bag can be suspended. This has the related advantage of correctly positioning the punching bag, even for relatively tall users, or even when constrained by the height of a standard ceiling.

As yet another advantage, undesirable swinging of the punching bag is inhibited, not only by the shorter length of the present invention, but also by virtue of the tight tolerances used in mounting movable rod 43 within sleeve 65.

Additional advantages and variations will be apparent to those skilled in the art, and such variations, as well as others which skill or fancy may suggest, are intended to be within the scope of the present invention, along with equivalents thereto, the invention being defined by the claims appended hereto.

What is claimed is:

1. A mount for securing a punching bag to a support structure, the mount comprising:

means for attaching the punching bag;

means for rotating the attaching means in response to rotation of the punching bag; and means for absorbing longitudinal forces exerted on the attaching means;

the rotating means and the absorbing means each having corresponding lengths, the rotating means being nonserially connected to the absorbing means to define a predetermined length, the predetermined length not exceeding the longer one of the rotating means and the absorbing means wherein the rotating means comprises a rod rotatably and slidably received through an aperture defined in the support structure, the rod operatively connected to the attaching means;

wherein the absorbing means comprises spring means between the rod and the stand;

wherein forces associated with sliding motion of the rod relative to the support structure during use of the bag are absorbed by the spring means, wherein the spring means comprises a helical spring coaxially received around the rod, the spring having one end biased relative to the support structure and the other end biased relative to the rod, the spring having an operative length not greater than the length of the rod, so that the spring does not increase the length of the mount.

2. The mount of claim 1, wherein the mount has a longitudinal axis, and further comprising means for inhibiting tilting of the rod relative to the longitudinal axis, whereby forces normal to the axis caused by swinging of the bag do not cause corresponding motion of the rod.

3. The mount of claim 2, wherein the means for inhibiting tilting comprises:

an inner wall defining a longitudinal passage in the mount, the rod being slidably received in the passage; and a longitudinal, circumferential sidewall defined in the rod, the sidewall opposing and in close proximity to a corresponding portion of the inner wall of the passage.

4. The mount of claim 1, wherein the attaching means comprises means for suspending the punching bag at a predetermined height.

5. The mount of claim 1, further comprising means for dampening longitudinal forces exerted on the attaching means.

6. The mount of claim 5, further comprising an inner wall defining a longitudinal passage in the mount, and wherein the dampening means comprises a component slidably mounted relative to the inner wall and with portions engaging the inner wall.

7. A mount for securing a punching bag to a support structure, the mount comprising:

means for attaching the punching bag;

means for rotating the attaching means in response to rotation of the punching bag;

means for absorbing longitudinal forces exerted on the attaching means;

means for dampening longitudinal forces exerted on the attaching means;

an inner wall defining a longitudinal passage in the mount, wherein the dampening means comprises a component slidably mounted relative to the inner wall and with portions engaging the inner wall;

wherein the component is elastomeric and has side portions engaging the inner wall, and further comprising means for selectively compressing the elastomeric component to adjust the engagement of the side portions with the inner wall, thereby adjusting the amount of dampening.

8. A mount for securing a punching bag at a predetermined height, the mount comprising:

means for suspending the punching bag at the predetermined height;

a circumferential wall defining a passage in the mount;

a rod slidably received in the passage and operatively connected to the suspending means; and a helical spring coaxially received around the rod, the spring having one end biased relative to the mount and the other end biased relative to the rod so as to be in a compressed state, sliding motion of the rod during use of the bag being absorbed by the spring, the spring having an operative length not greater than the length of the rod, so that the spring does not increase the length of the mount, the resulting nonserial connection of the rod and the spring increasing the maximum height at which the bag is suspended.

9. The mount of claim 8, further comprising means for swiveling the bag in response to rotational forces exerted thereon.

10. A mount for securing a punching bag to a support structure, the mount comprising:

means for attaching the punching bag;

means for rotating the attaching means in response to rotation of the punching bag; and means for absorbing longitudinal forces exerted on the attaching means;

the rotating means and the absorbing means each having corresponding lengths, the rotating means being nonserially connected to the absorbing means to define a predetermined length, the predetermined length not exceeding the longer one of the rotating means and the absorbing means;

wherein the rotating means comprises a rod rotatable received through an aperture defined in the mount, the rod operatively connected to the attaching means;

wherein the rod is slidable relative to the support structure, wherein the absorbing means comprises spring means between the rod and the support structure, and wherein forces associated with sliding motion of the rod relative to the support structure during use of the bag are absorbed by the spring means; and further comprising means for limiting longitudinal movement of the rod relative to the support structure, and means for adjusting the characteristics of the spring means, wherein the limiting means comprises a cap with a surface opposing an end of the rod, the rod contacting the opposing surface of the cap when the rod is longitudinally displaced by a predetermined amount; and wherein the adjusting means comprises a nut threadably received on the rod, the nut being in operative contact with the spring means and movable toward and away from the spring means to adjust the spring tension.

11. A stand for exercise equipment, such as punching bags, the stand comprising:

a base, an arm, and means for securing the arm at a predetermined height above the base; and a mount secured to the arm and comprising:

means for attaching the punching bag;

means for rotating the attaching means in response to rotation of the punching bag; and means for absorbing longitudinal forces exerted on the attaching means;

the rotating means and the absorbing means each having corresponding lengths, the rotating means being nonserially connected to the absorbing means, whereby the mount has a predetermined length not exceeding the longer one of the rotating means and the absorbing means, the nonserial connection of the rotating means and the absorbing means increasing the maximum value of the predetermined height at which the bag can be suspended from the stand;

wherein the rotating means comprises a rod rotatably and slidably received through an aperture defined in the stand, the rod operatively connected to the attaching means;

wherein the absorbing means comprises spring means between the rod and the stand;

wherein forces associated with sliding motion of the rod relative to the stand during use of the bag are absorbed by the spring means; and wherein the spring means comprises a helical spring coaxially received around the rod, the spring having one end biased relative to the stand and the other end biased relative to the rod, the spring having an operative length not greater than the length of the rod, so that the spring does not increase the length of the mount.

12. The mount of claim 11, further comprising means for limiting longitudinal movement of the rod relative to the support structure, and means for adjusting the characteristics of the spring means.

13. The mount of claim 12, wherein the limiting means comprises a cap with a surface opposing an end of the rod, the rod contacting the opposing surface of the cap when the rod is longitudinally displaced by a predetermined amount; and wherein the adjusting means comprises a nut threadably received on the rod, the nut being in operative contact with the spring means and movable toward and away from the spring means to adjust the spring tension.

14. The mount of claim 11, wherein the mount has a longitudinal axis, and further comprising means for inhibiting tilting of the rod relative to the longitudinal axis, whereby forces normal to the axis caused by swinging of the bag do not cause corresponding motion of the rod.

15. The mount of claim 14, wherein the means for inhibiting tilting comprises:

an inner wall defining a longitudinal passage in the mount, the rod being slidably received in the passage; and a longitudinal, circumferential sidewall defined in the rod, the sidewall opposing and in close proximity to a corresponding portion of the inner wall of the passage.

16. The mount of claim 11, further comprising means for dampening longitudinal forces exerted on the attaching means.

17. The mount of claim 16, further comprising an inner wall defining a longitudinal passage in the mount, and wherein the dampening means comprises a component slidably mounted relative to the inner wall and with portions engaging the inner wall.

18. The mount of claim 17, wherein the component is elastomeric and has side portions engaging the inner wall, and further comprising means for selectively compressing the elastomeric component to adjust the engagement of the side portions with the inner wall, thereby adjusting the amount of dampening.

19. A support structure for a heavy punching bag, the structure comprising:

a mount from which the punching bag is suspended; and means for securing the mount at a predetermined height above a horizontal plane;

the mount further comprising:

a rod rotatably and slidably received in a passage defined in the support structure and connected to the suspending means;

means for swiveling the bag in response to rotational forces exerted thereon;

spring means operatively associated with the rod, the spring means being in a compressed state when the bag is suspended on the mount, whereby forces associated with sliding motion of the rod during use of the bag are absorbed by the spring means, the compressed state of the spring means not increasing the length of the mount and thereby increasing the maximum height at which the bag is suspended wherein the spring means comprises a helical spring coaxially received around the rod, the spring having one end biased relative to the structure and the other end biased relative to the rod, the spring having an operative length not greater than the length of the rod, the resulting nonserial connection of the rod and the spring increasing the maximum height at which the bag is suspended.

20. The support structure of claim 19, wherein the spring means comprises a gas cylinder, the rod received in the gas cylinder, the gas being compressed when the bag is suspended thereon.

21. The support structure of claim 19, wherein the securing means comprises means for attaching the mount relative to a ceiling.

22. The support structure of claim 21, wherein the means for attaching the mount relative to a ceiling comprises a crossbeam connected to the mount, the crossbeam having opposite ends extending outwardly from the mount.

23. The support structure of claim 19, wherein the securing means comprises a plurality of interconnected, elongated members, one of the members comprising an arm, the mount being secured to the arm, at least one of the other elongated members defining means for attaching the mount relative to a vertical surface.

24. The support structure of claim 19, wherein the securing means comprises a stand with a base for placement on a horizontal surface, an elongated member extending vertically upwardly from the base, and at least one arm extending outwardly from the vertical member, the mount being secured to the arm.

25. A mount for securing a punching bag to a support structure, comprising:

a clip for securing to the punching bag;

a sleeve for securing to the support structure, the sleeve having first and second opposite ends and an inner wall extending between the ends;

a rod having a first rod end protruding from the first end of the sleeve and secured to the clip, the rod extending longitudinally into the sleeve and terminating in a second rod end, the rod having a diameter less than the sleeve, whereby the clip can swivel and be displaced longitudinally relative to the sleeve;

a helical spring coaxially received around the rod and extending longitudinally within the sleeve;

a friction-reducing bushing interposed between the inner wall of the sleeve and the spring;

a mounting bushing secured relative to the first end of the sleeve;

a nut threadably received at the second rod end, the helical spring extending between the nut and the bushing and being biased relative to the nut and the bushing to absorb longitudinal forces experienced by the clip during use of the punching bag;

the nut being adjustable to advance and retract relative to the spring to adjust the tension of the spring;

the sleeve having a predetermined length, the spring having a spring constant selected to maintain the rod substantially within the sleeve during the absorption of forces by the spring, whereby, when the mount is oriented with the clip protruding downwardly from the sleeve, the bag attached to the clip is suspended at a vertical location adjacent to the first sleeve end, and the vertical distance between the top of the bag and the sleeve is substantially minimized;

the clip comprising a yoke with a base secured to the first rod end and a pair of substantially parallel arms extending outwardly from the base, the clip further comprising a pin for receiving the punching bag thereon, the pin extending transversely between the arms;

the sleeve having a cap secured at the second end of the sleeve, the cap located longitudinally along the sleeve to limit longitudinal movement of the rod relative to the sleeve;

the mounting bushing having an inner bushing wall defining an aperture through which the first rod end extends, the inner bushing wall opposing and in close proximity to the rod to keep the rod from tilting relative to the sleeve to inhibit swinging of the punching bag.

* * * * *